United States Patent [19]

Evans et al.

[11] Patent Number: 4,948,776

[45] Date of Patent: Aug. 14, 1990

[54] INFRARED ABSORBING CHALCOGENOPYRYLO-ARYLIDENE DYES FOR DYE-DONOR ELEMENT USED IN LASER-INDUCED THERMAL DYE TRANSFER

[75] Inventors: Steven Evans; Charles D. DeBoer, both of Rochester, N.Y.

[73] Assignee: Eastman Kodak Company, Rochester, N.Y.

[21] Appl. No.: 366,969

[22] Filed: Jun. 16, 1989

[51] Int. Cl.[5] ..... B41M 5/035; B41M 5/26

[52] U.S. Cl. ..... 503/227; 8/471; 428/195; 428/480; 428/913; 428/914; 430/200; 430/201; 430/202; 430/945

[58] Field of Search ..... 8/471; 428/195, 480, 428/913, 914; 503/227; 430/200–202, 945

[56] References Cited

FOREIGN PATENT DOCUMENTS 2083726 3/1982 United Kingdom ..... 503/227

OTHER PUBLICATIONS

Helv. Chim. Acta 39, 217 (1956) (Wizinger et al.).

*Primary Examiner*—Bruce H. Hess

*Attorney, Agent, or Firm*—Harold E. Cole

[57] ABSTRACT

A dye-donor element for laser-induced thermal dye transfer comprising a support having thereon a dye layer and an infrared-absorbing material which is different from the dye in the dye layer, and wherein the infrared-absorbing material is a chalcogenopyrylo-arylidene dye. In a preferred embodiment, the chalcogenopyrylo-arylidene dye has the following formula:

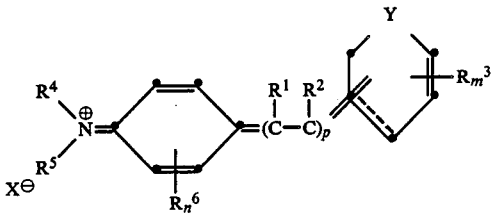

wherein:

$R^1$ and $R^2$ each independently represents hydrogen, halogen, cyano, alkoxy, aryloxy, acyloxy, aryloxycarbonyl, alkoxycarbonyl, sulfonyl, carbamoyl, acyl, acylamido, alkylamino, arylamino or a substituted or unsubstituted alkyl, aryl or hetaryl group; or any of $R^1$ and $R^2$ may be joined together or with an adjacent aromatic ring to complete a 5- to 7-membered substituted or unsubstituted carbocyclic or heterocyclic ring;

$R^3$ and $R^6$ each independently represents $R^1$ or the atoms necessary to complete a 5- to 7-membered fused substituted or unsubstituted carbocyclic or heterocyclic ring;

$R^4$ and $R^5$ each independently represents a substituted or unsubstituted alkyl or cycloalkyl group having from 1 to about 6 carbon atoms or an aryl or hetaryl group having from about 5 to about 10 atoms;

or $R^4$ and $R^5$ may be joined together or to the carbon atom of the adjacent aromatic ring at a position ortho to the position of attachment of the anilino nitrogen to form, along with the nitrogen to which they are attached, a 5- to 7-membered heterocyclic ring;

Y is oxygen, sulfur, selenium or tellurium with the methine chain being joined ortho or para to Y;

X is a monovalent anion;

n and m are 4; and p is 1-3, with the proviso that when Y is oxygen, then p is 2 or 3.

17 Claims, No Drawings

INFRARED ABSORBING CHALCOGENOPYRYLO-ARYLIDENE DYES FOR DYE-DONOR ELEMENT USED IN LASER-INDUCED THERMAL DYE TRANSFER

This invention relates to dye-donor elements used in laser induced thermal dye transfer, and more particularly to the use of certain infrared-absorbing chalcogenopyrylo-arylidene dyes.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB No. 2,083,726A, the disclosure of which is hereby incorporated by reference.

In GB No. 2,083,726A, the absorbing material which is disclosed for use in their laser system is carbon. There is a problem with using carbon as the absorbing material in that it is particulate and has a tendency to clump when coated which may degrade the transferred dye image. Also, carbon may transfer to the receiver by sticking or ablation causing a mottled or desaturated color image. It would be desirable to find an absorbing material which did not have these disadvantages.

These and other objects are achieved in accordance with this invention which relates to a dye-donor element for laser-induced thermal dye transfer comprising a support having thereon a dye layer and an infrared-absorbing material which is different from the dye in the dye layer, and wherein the infrared-absorbing material is a chalcogenopyrylo-arylidene dye.

In a preferred embodiment of the invention, the chalcogenopyrylo-arylidene dye has the following formula:

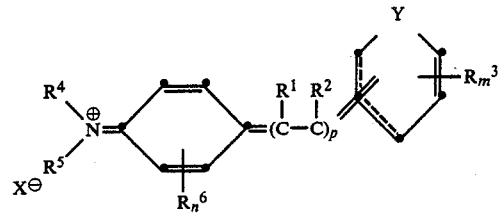

wherein:

$R^1$ and $R^2$ each independently represents hydrogen, halogen such as chlorine, bromine, fluorine or iodine; cyano; alkoxy such as methoxy, 2-ethoxyethoxy or benzyloxy; aryloxy such as phenoxy, 3-pyridyloxy, 1-naphthoxy or 3-thienyloxy; acyloxy such as acetoxy, benzoyloxy or phenylacetoxy; aryloxycarbonyl such as phenoxycarbonyl or m-methoxyphenoxycarbonyl; alkoxycarbonyl such as methoxycarbonyl, butoxycarbonyl or 2-cyanoethoxycarbonyl; sulfonyl such as methanesulfonyl, cyclohexanesulfonyl, p-toluenesulfonyl, 6-quinolinesulfonyl or 2-naphthalenesulfonyl; carbamoyl such as N-phenylcarbamoyl, N,N-dimethylcarbamoyl, N-phenyl-N-ethylcarbamoyl or N-isopropyl-carbamoyl; acyl such as benzoyl, phenylacetyl or acetyl; acylamido such as p-toluenesulfonamido, benzamido or acetamido; alkylamino such as diethylamino, ethylbenzylamino or isopropylamino; arylamino such as anilino, diphenylamino or N-ethylanilino; or a substituted or unsubstituted alkyl, aryl or hetaryl group, such as cyclopentyl, t-butyl, 2-ethoxyethyl, n-hexyl, benzyl, 3-chlorophenyl, 2-imidazolyl, 2-naphthyl, 4-pyridyl, methyl, ethyl, phenyl or m-tolyl; or any of $R^1$ and $R^2$ may be joined together or with an adjacent aromatic ring to complete a 5- to 7-membered substituted or unsubstituted carbocyclic or heterocyclic ring, such as tetrahydropyran, cyclopentene or 4,4-dimethylcyclohexene;

$R^3$ and $R^6$ each independently represents $R^1$ or the atoms necessary to complete a 5-to 7-membered fused substituted or unsubstituted carbocyclic or heterocyclic ring, thus forming a multicyclic ring system such as naphthalene, quinoline, indole or benzothiazole;

$R^4$ and $R^5$ each independently represents a substituted or unsubstituted alkyl or cycloalkyl group having from 1 to about 6 carbon atoms or an aryl or hetaryl group having from about 5 to about 10 atoms such as those listed above for $R^1$;

or $R^4$ and $R^5$ may be joined together or to the carbon atom of the adjacent aromatic ring at a position ortho to the position of attachment of the anilino nitrogen to form, along with the nitrogen to which they are attached, a 5- to 7-membered heterocyclic ring, thus forming a multicyclic system such as tetrahydroquinoline or julolidine; Y is oxygen, sulfur, selenium or tellurium with the methine chain being joined ortho or para to Y;

X is a monovalent anion such as $CF_3SO_3$, I, p-$(CH_3)C_6H_4SO_3$, $CF_3CO_2$, Br, Cl, $PF_6$ or $ClO_4$;

n and m are 4; and p is 1–3, with the proviso that when Y is oxygen, then p is 2 or 3.

In a preferred embodiment of the invention, Y is sulfur. In another preferred embodiment, $R^1$ is dimethylaminophenyl. In still another preferred embodiment, $R^3$ is phenyl and $R^4$ and $R^5$ are both methyl.

The above infrared-absorbing dyes may employed in any concentration which is effective for the intended purpose. In general, good results have been obtained at a concentration from about 0.05 to about 0.5 g/m$^2$ within the dye layer itself or in an adjacent layer.

The above infrared-absorbing dyes may be synthesized by procedures similar those described in Helv. Chim. Acta 39, 217 (1956).

Spacer beads may be employed in a separate layer over the dye layer in order to separate the dye-donor from the dye-receiver thereby increasing the uniformity and density of dye transfer. That invention is more fully described in U.S. Pat. No. 4,772,582. The spacer beads may be coated with a polymeric binder if desired.

Dyes included within the scope of the invention include the following:

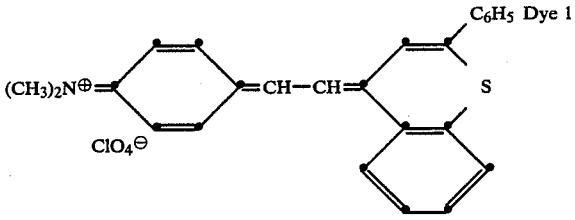

λmax = 714 in dichloromethane

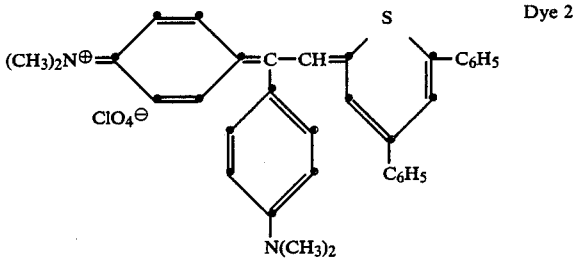

λmax = 705 in dichloromethane

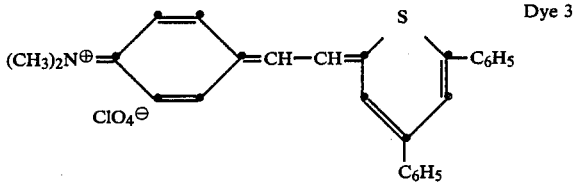

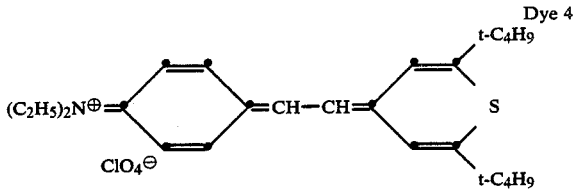

-continued

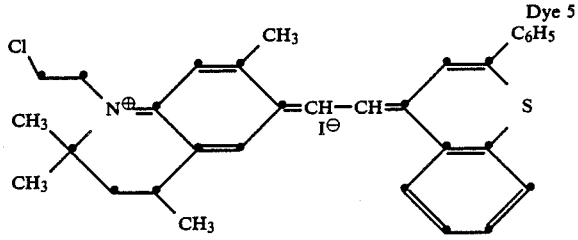

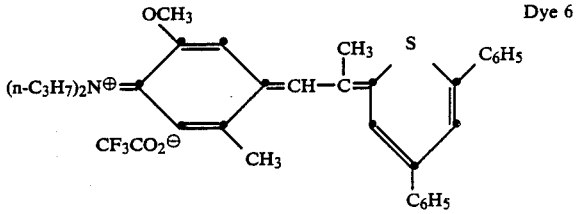

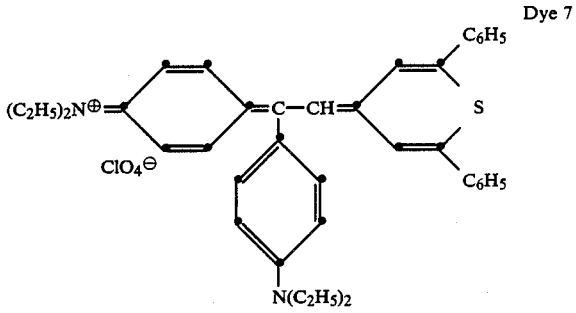

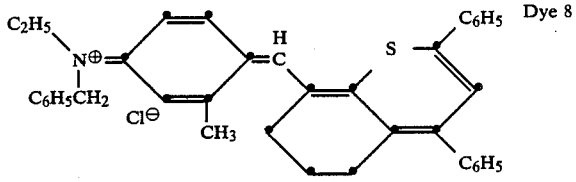

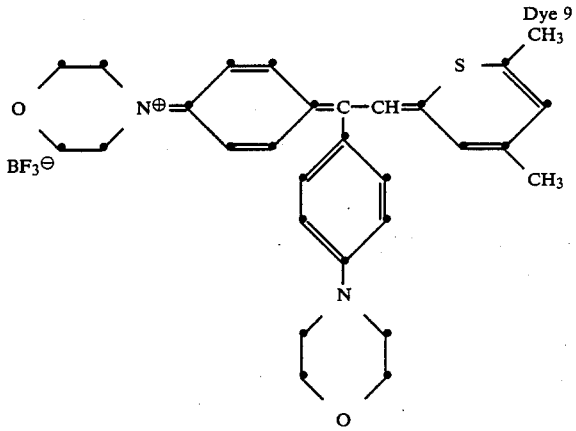

-continued

Dye 10

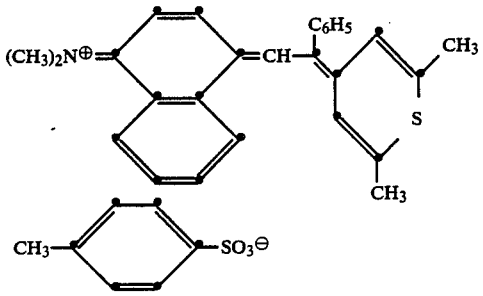

Dye 11

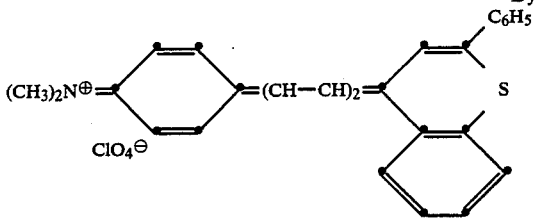

Dye 12

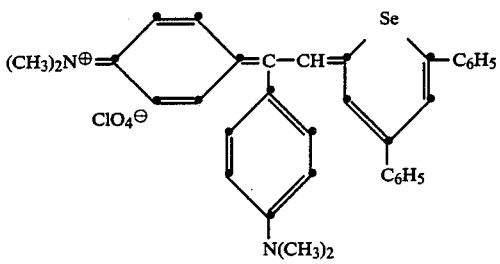

Dye 13

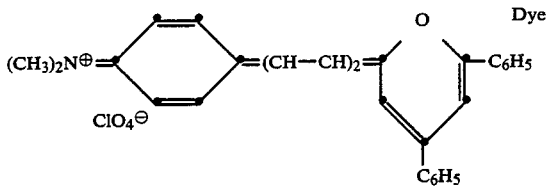

Dye 14

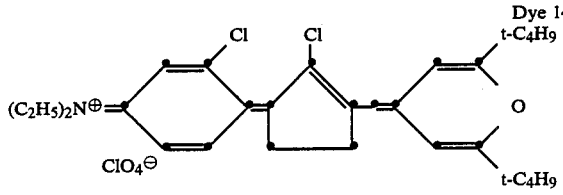

Dye 15

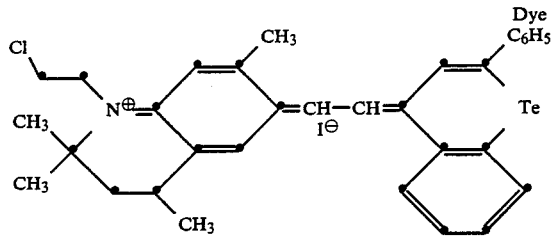

-continued

Dye 16

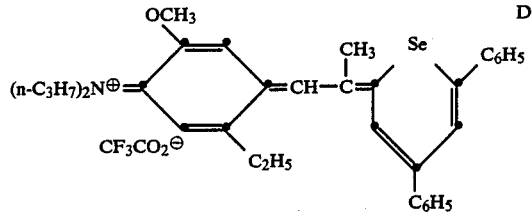

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (Sumitomo Chemical Co., Ltd.), Dianix Fast Violet 3R-FS ® (Mitsubishi Chemical Industries, Ltd.), and Kayalon Polyol Brilliant Blue N-BGM ® and KST Black 146 ® (Nippon Kayaku Co., Ltd.); azo dyes such as Kayalon Polyol Brilliant Blue BM ®, Kayalon Polyol Dark Blue 2BM ®, and KST Black KR ® (Nippon Kayaku Co., Ltd.), Sumickaron Diazo Black 5G ® (Sumitomo Chemical Co., Ltd.), and Miktazol Black 5GH ® (Mitsui Toatsu Chemicals, Inc.); direct dyes such as Direct Dark Green B ® (Mitsubishi Chemical Industries, Ltd.) and Direct Brown M ® and Direct Fast Black D ® (Nippon Kayaku Co. Ltd.); acid dyes such as Kayanol Milling Cyanine 5R ® (Nippon Kayaku Co. Ltd.); basic dyes such as Sumicacryl Blue 6G ® (Sumitomo Chemical Co., Ltd.), and Aizen Malachite Green ® (Hodogaya Chemical Co., Ltd.);

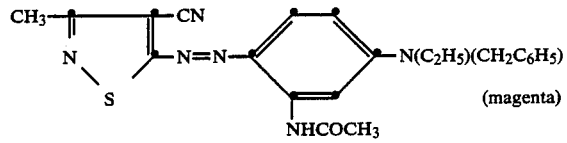

(magenta)

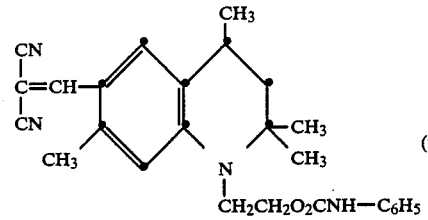

(yellow)

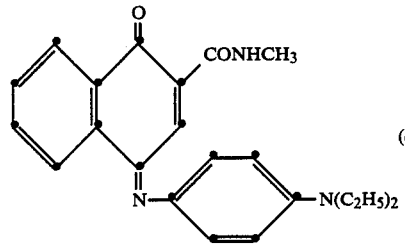

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-coacrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat generated by the laser beam. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers. The support generally has a thickness of from cabout 2 to about 250 μm. It may also be coated with a subbing layer, if desired.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene coated paper, white polyester (polyester with white pigment incorporated therein), an ivory paper, a condenser paper or a synthetic paper such as duPont Tyvek®.

The dye image-receiving layer may comprise, for example, a polycarbonate, a polyurethane, a polyester, polyvinyl chloride, poly(styrene-coacrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above using a laser, and transferring a dye image to a dye-receiving element to form the dye transfer image.

The dye-donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Several different kinds of lasers could conceivably be used to effect the thermal transfer of dye from a donor sheet to a receiver, such as ion gas lasers like argon and krypton; metal vapor lasers such as copper, gold, and cadmium; solid state lasers such as ruby or YAG; or diode lasers such as gallium arsenide emitting in the infrared region from 750 to 870 nm. However, in practice, the diode lasers offer substantial advantages in terms of their small size, low cost, stability, reliability, ruggedness, and ease of modulation. In practice, before any laser can be used to heat a dye-donor element, the laser radiation must be absorbed into the dye layer and converted to heat by a molecular process known as internal conversion. Thus, the construction of a useful dye layer will depend not only on the hue, sublimability and intensity of the image dye, but also on the ability of the dye layer to absorb the radiation and convert it to heat.

Lasers which can be used to transfer dye from the dye-donor elements of the invention are available commercially. There can be employed, for example, Laser Model SDL-2420-H2® from Spectrodiode Labs, or Laser Model SLD 304 V/W® from Sony Corp.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is adjacent to and overlying the image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied using the laser beam. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE 1 - MAGENTA DYE-DONOR

A dye-donor element according to the invention was prepared by coating an unsubbed 100 μm thick poly(ethylene terephthalate) support with a layer of the magenta dye illustrated above (0.38 g/m$^2$), the infrared-absorbing dye indicated in Table 1 below (0.14 g/m$^2$) in a cellulose acetate propionate binder (2.5% acetyl, 45% propionyl) (0.27 g/m$^2$) coated from methylene chloride.

A control dye-donor element was made as above containing only the magenta imaging dye.

Other control dye-donor elements were prepared as described above but containing the following control dyes:

C-1

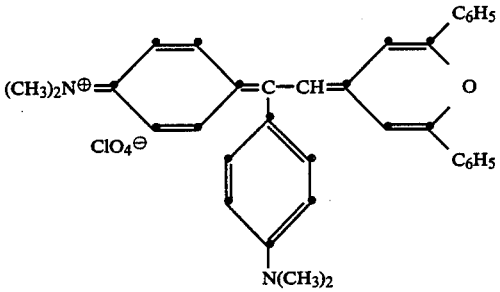

λmax = 649 nm in dichloromethane

C-2

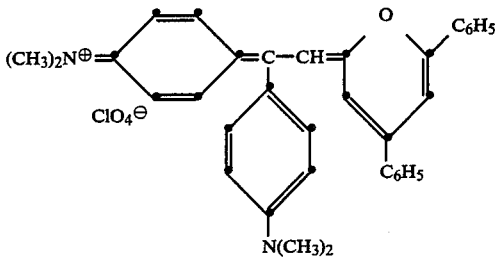

λmax = 670 nm in dichloromethane

A commercial clay-coated matte finish lithographic printing paper (80 pound Mountie-Matte from the Seneca Paper Company) was used as the dye-receiving element.

The dye-receiver was overlaid with the dye-donor placed on a drum with a circumference of 295 mm and taped with just sufficient tension to be able to see the deformation of the surface of the dye-donor by reflected light. The assembly was then exposed with the drum rotating at 180 rpm to a focused 830 nm laser beam from a Spectra Diode Labs laser model SDL-2430-H2 using a 33 micrometer spot diameter and an exposure time of 37 microseconds. The spacing between lines was 20 micrometers, giving an overlap from line to line of 39%. The total area of dye transfer to the receiver was 6×6 mm. The power level of the laser was approximately 180 milliwatts and the exposure energy, including overlap, was 0.1 ergs per square micron.

The Status A green reflection density of each transferred dye area was read as follows:

TABLE 1

| Infrared Dye in Donor | Status A Green Density Transferred to Receiver |
|---|---|
| None (control) | 0.0 |
| Control C-1 | 0.0 |
| Control C-2 | 0.0 |
| Dye 1 | 0.8 |
| Dye 2 | 0.5 |

The above results indicate that all the coatings containing an infrared-absorbing dye according to the invention gave substantially more density than the controls.

The invention has been described in detail with particular reference to preferred embodiments thereof, but it will be understood that variations and modifications can be effected within the spirit and scope of the invention.

What is claimed is:

1. In a dye-donor element for laser-induced thermal dye transfer comprising a support having thereon a dye layer and an infrared-absorbing material which is different from the dye in said dye layer, the improvement wherein said infrared-absorbing material is a chalcogenopyrylo-arylidene dye having the following formula:

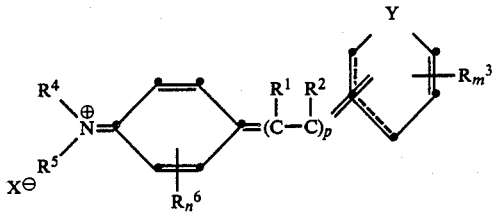

wherein:

$R^1$ and $R^2$ each independently represents hydrogen, halogen, cyano, alkoxy, aryloxy, acyloxy, aryloxycarbonyl, alkoxycarbonyl, sulfonyl, carbamoyl, acyl, acylamido, alkylamino, arylamino or a substituted or unsubstituted alkyl, aryl or hetaryl group; or any of $R^1$ and $R^2$ may be joined together or with an adjacent aromatic ring to complete a 5- to 7-membered substituted or unsubstituted carboxylic or heterocyclic ring;

$R^3$ and $R^6$ each independently represents $R^1$ or the atoms necessary to complete a 5- to 7-membered fused substituted or unsubstituted carbocyclic or heterocyclic ring;

$R^4$ and $R^5$ each independently represents a substituted or unsubstituted alkyl or cycloalkyl group having from 1 to about 6 carbon atoms or an aryl or hetaryl group having from about 5 to about 10 atoms;

or $R^4$ and $R^5$ may be joined together or to the carbon atom of the adjacent aromatic ring at a position ortho to the position of attachment of the anilino nitrogen to form, along with the nitrogen to which they are attached, a 5- to 7-membered heterocyclic ring; Y is oxygen, sulfur, selenium or tellurium with the methine chain being joined ortho or para to Y;

X is a monovalent anion;

n and m are 4; and p is 1-3, with the proviso that when Y is oxygen, the p is 2 or 3.

2. The element of claim 1 wherein Y is sulfur.

3. The element of claim 1 wherein $R^1$ is dimethylaminophenyl.

4. The element of claim 1 wherein $R^3$ is phenyl.

5. The element of claim 1 wherein $R^4$ and $R^5$ are both methyl.

6. The element of claim 1 wherein said dye layer comprises sequential repeating areas of cyan, magenta and yellow dye.

7. In a process of forming a laser-induced thermal dye transfer image comprising (a) imagewise-heating by means of a laser a dye-donor element comprising a support having thereon a dye layer and an infrared-absorbing material which is different from the dye in said dye layer, and (b) transferring a dye image to a dye-receiving element to form said laser-induced thermal dye transfer image, the improvement wherein said infrared-absorbing material is a chalcogenopyrylo-arylidene dye having the following formula:

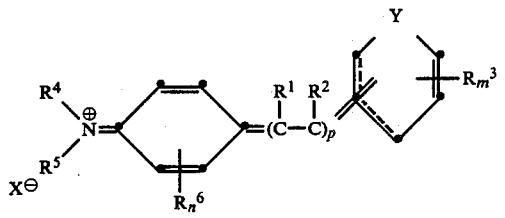

wherein:

$R^1$ and $R^2$ each independently represents hydrogen, halogen, cyano, alkoxy, aryloxy, acyloxy, aryloxycarbonyl, alkoxycarbonyl, sulfonyl, carbamoyl, acyl, acylamido, alkylamino, arylamino or a substituted or unsubstituted alkyl, aryl or hetaryl group; or any of $R^1$ and $R^2$ may be joined together or with an adjacent aromatic ring to complete a 5- to 7-membered substituted or unsubstituted carbocyclic or heterocyclic ring;

$R^3$ and $R^6$ each independently represents $R^1$ or the atoms necessary to complete a 5- to 7-membered fused substituted or unsubstituted carbocyclic or heterocyclic ring;

$R^4$ and $R^5$ each independently represents a substituted or unsubstituted alkyl or cycloalkyl group having from 1 to about 6 carbon atoms or an aryl or hetaryl group having from about 5 to about 10 atoms;

or $R^4$ and $R^5$ may be joined together or to the carbon atom of the adjacent aromatic ring at a position ortho to the position of attachment of the anilino nitrogen to form, along with the nitrogen to which they are attached, a 5- to 7-membered heterocyclic ring; Y is oxygen, sulfur, selenium or tellurium with the methine chain being joined ortho or para to Y;

X is a monovalent anion;

n and m are 4; and p is 1-3, with the proviso that when Y is oxygen, then p is 2 or 3.

8. The process of claim 7 wherein Y is sulfur.

9. The process of claim 7 wherein $R^1$ is dimethylaminophenyl.

10. The process of claim 7 wherein $R^3$ is phenyl and $R^4$ and $R^5$ are both methyl.

11. The process of claim 7 wherein said support is poly(ethylene terephthalate) which is coated with sequential repeating areas of cyan, magenta and yellow dye, and said process steps are sequentially performed for each color to obtain a three-color dye transfer image.

12. In a thermal dye transfer assemblage comprising:

(a) a dye-donor element comprising a support having a dye layer and an infrared-absorbing material which is different from the dye in said dye layer, and (b) a dye-receiving element comprising a support having thereon a dye image-receiving layer, said dye-receiving element being in a superposed relationship with said dye-donor element so that said dye layer is adjacent to said dye image-receiving layer, the improvement wherein said infrared-absorbing material is a chalcogenopyrylo-arylidene dye having the following formula:

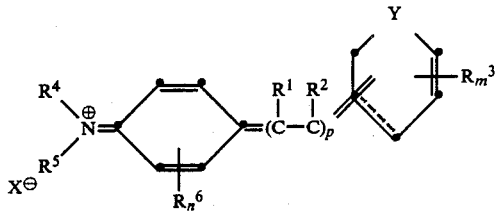

wherein:

$R^1$ and $R^2$ each independently represents hydrogen, halogen, cyano, alkoxy, aryloxy, acyloxy, aryloxycarbonyl, alkoxycarbonyl, sulfonyl, carbamoyl, acyl, acylamido, alkylamino, arylamino or a substituted or unsubstituted alkyl, aryl or hetaryl group; or any of $R^1$ and $R^2$ may be joined together or with an adjacent aromatic ring to complete a 5- to 7-membered substituted or unsubstituted carbocyclic or heterocyclic ring;

$R^3$ and $R^6$ each independently represents $R^1$ or the atoms necessary to complete a 5- to 7-membered fused substituted or unsubstituted carbocyclic or heterocyclic ring;

$R^4$ and $R^5$ each independently represents a substituted or unsubstituted alkyl or cycloalkyl group having from 1 to about 6 carbon atoms or an aryl or hetaryl group having from about 5 to about 10 atoms;

or $R^4$ and $R^5$ may be joined together or to the carbon atom of the adjacent aromatic ring at a position ortho to the position of attachment of the anilino nitrogen to form, along with the nitrogen to which they are attached, a 5- to 7-membered heterocyclic ring; Y is oxygen, sulfur, selenium or tellurium with the methine chain being joined ortho or para to Y;

X is a monovalent anion;

n and m are 4; and p is 1-3, with the proviso that when Y is oxygen, then p is 2 or 3.

13. The assemblage of claim 12 wherein Y is sulfur.

14. The assemblage of claim 12 wherein $R^1$ is dimethylaminophenyl.

15. The assemblage of claim 12 wherein $R^3$ is phenyl.

16. The assemblage of claim 12 wherein $R^4$ and $R^5$ are both methyl.

17. The assemblage of claim 12 wherein said support of the dye-donor element comprises poly(ethylene terephthalate) and said dye layer comprises sequential repeating areas of cyan, magenta and yellow dye.

* * * * *